US007178685B2

(12) United States Patent
Hidalgo et al.

(10) Patent No.: US 7,178,685 B2
(45) Date of Patent: Feb. 20, 2007

(54) STRAW RECEPTACLE LID

(75) Inventors: Craig A. Hidalgo, Langhorne, PA (US); Thomas J. Powers, Fairless Hills, PA (US); Alexander J. Sinton, Doylestown, PA (US); Joseph F. Brewin, Franklin, MA (US); John A. Hession, Braintree, MA (US)

(73) Assignee: The First Years Inc., Avon, MA (US)

( * ) Notice: Subject to any disclaimer, the term of this patent is extended or adjusted under 35 U.S.C. 154(b) by 0 days.

(21) Appl. No.: 10/457,254

(22) Filed: Jun. 9, 2003

(65) Prior Publication Data

US 2004/0245250 A1 Dec. 9, 2004

(51) Int. Cl.
*B65D 51/00* (2006.01)
*B65D 41/16* (2006.01)
*A47G 19/22* (2006.01)

(52) U.S. Cl. ..... 220/229; 220/709; 220/780; 220/254.1

(58) Field of Classification Search ..... 220/705, 220/709, 713, 229, 254.1, 258.5; 215/388
See application file for complete search history.

(56) References Cited

U.S. PATENT DOCUMENTS

| | | | | |
|---|---|---|---|---|
| 2,213,465 A | | 9/1940 | Gay | |
| 2,436,291 A | | 2/1948 | Daniel | |
| 3,048,317 A | * | 8/1962 | Cochrane et al. | 229/103.1 |
| 3,478,922 A | | 11/1969 | Mole | |
| 3,524,566 A | * | 8/1970 | Parks | 220/268 |
| D225,308 S | | 12/1972 | Barefoot | |
| 3,850,337 A | | 11/1974 | Parks | |
| 3,874,554 A | * | 4/1975 | Chang | 220/708 |
| 3,899,100 A | * | 8/1975 | Rigaud | 220/229 |
| 4,037,754 A | | 7/1977 | Wilhelmi et al. | |
| 4,053,084 A | | 10/1977 | Anderson | |
| 4,284,196 A | * | 8/1981 | Lagerkvist | 206/528 |
| 4,438,865 A | | 3/1984 | Scattaregia | |
| 4,600,112 A | | 7/1986 | Shillington et al. | |
| 4,948,009 A | | 8/1990 | Sawatani | |
| 5,054,684 A | * | 10/1991 | Farber et al. | 229/103.1 |

(Continued)

FOREIGN PATENT DOCUMENTS

DE 100 57 277 5/2002

(Continued)

*Primary Examiner*—Nathan J. Newhouse
*Assistant Examiner*—James Smalley
(74) *Attorney, Agent, or Firm*—Michael Best & Friedrich LLP

(57) ABSTRACT

A lids for a child's drinking cup has a projection extending integrally from an underside of the lid, the projection defining, in an upper surface of the lid body, a straw receptacle. The projection defines a plurality of break lines, such as slits, terminating at break line ends and defining separable segments of the projection. The break line ends are spaced from the base of the projection in a region of the straw receptacle having a cross-section approximately equal in extent to a cross-section of a corresponding drinking straw, such that inserting the straw into the straw receptacle and through the projection forces the projection segments apart, the segment bases engaging an outer surface of the inserted straw to inhibit leakage. Some of the projections include molded stiffening ribs.

43 Claims, 5 Drawing Sheets

U.S. PATENT DOCUMENTS

| | | | | | |
|---|---|---|---|---|---|
| 5,111,946 | A | | 5/1992 | Glanz | |
| 5,147,065 | A | | 9/1992 | Rush et al. | |
| 5,297,599 | A | | 3/1994 | Bucheli | |
| 5,381,924 | A | | 1/1995 | Kiefel | |
| 5,397,023 | A | | 3/1995 | Toczek et al. | |
| 5,425,465 | A | | 6/1995 | Healy | |
| 5,425,471 | A | | 6/1995 | Wendt | |
| 5,687,867 | A | * | 11/1997 | Lamoureux | 215/303 |
| 5,709,309 | A | | 1/1998 | Gallagher et al. | |
| 5,937,921 | A | * | 8/1999 | Guglielmini | 141/351 |
| 6,030,582 | A | | 2/2000 | Levy | |
| 6,032,812 | A | * | 3/2000 | Lamoureux | 215/303 |
| 6,286,698 | B2 | * | 9/2001 | Hague et al. | 215/201 |
| 6,361,744 | B1 | | 3/2002 | Levy | |
| 6,450,563 | B2 | | 9/2002 | Yee | |
| 6,505,753 | B1 | | 1/2003 | Freek et al. | |
| 2002/0131902 | A1 | | 9/2002 | Levy | |

FOREIGN PATENT DOCUMENTS

| | | |
|---|---|---|
| GB | 2 120 218 | 11/1983 |

* cited by examiner

STRAW RECEPTACLE LID

TECHNICAL FIELD

This invention relates to lids for containers, and more particularly to straw-insertable lids for drinking cups.

BACKGROUND

Drinking cups for children are often provided with removable lids to help prevent large spills. Some of these lids feature receptacles through which straws can be inserted to enable the children to access liquids contained in the cup. Insertion of a straw through such a receptacle typically creates an opening or enlarges a pre-existing opening defined in the lid. Consequently, if the cup is knocked over, the straw receptacle can be a source of significant leakage after a user inserts a straw though the straw-receptacle. This leakage can occur as a result of inadequate engagement between the lid and the straw while the straw is inserted and/or as a result of the opening defined in the lid remaining enlarged after the straw is removed.

Accordingly, it is desirable to inhibit leakage through the straw receptacle in the lid of a drinking cup knocked over with a straw inserted. It is also desirable to inhibit leakage through the straw receptacle in the lid of a drinking cup knocked over after an inserted straw is removed. More generally, it is desirable to inhibit leakage through openings in the lids of containers through which devices are inserted to access the contents.

SUMMARY

We have realized that it is possible to configure a removable lid for a drinking cup to enable insertion and removal of a straw while providing acceptable leakage prevention, preferably both when the straw is inserted and after the straw is removed. Aspects of the present invention include a straw and lid combination for a drinking cup, a removable lid for a drinking cup, and a method of drinking from a cup.

According to one aspect of the invention, a removable lid for a drinking cup has a body with a rim releasable securable about a lip of a drinking cup to form a seal, and a projection extending integrally from an underside of the body along a projection axis. In some embodiments, the rim is a peripheral groove sized to receive an upper rim of the cup. The lid may also have a snap ridge extending into the groove, or below the groove, at an outer edge thereof and positioned to snap under a rim of the cup when the cup and lid are fully engaged. In some cases, the snap ridge is discontinuous about a periphery of the lid. The rim is more fully described in pending patent application PCT/US02/31875, filed Oct. 4, 2002, the entire contents of which are incorporated here by reference.

The projection is a hollow structure defining a tapered side wall extending from a relatively broad base at the underside of the body to a distal end. The projection defines a straw receptacle in the lid body. The projection also defines break lines extending from its distal end and terminating at break line ends. The break lines define separable segments of the projection, each having a segment base extending between adjacent break line ends. The break line ends are disposed on the tapered side wall of the projection and are spaced from the base of the tapered side wall along the projection axis in a region of the straw receptacle having a line end cross-section such that inserting a straw, having a cross-section approximately equal in extent to the line end cross-section of the projection, into the straw receptacle and through the projection forces the projection segments apart, the segment bases engaging an outer surface of the inserted straw to inhibit leakage.

In some embodiments of the invention, the lid is a unitary piece of molded plastic forming a generally planar, rigid surface extending between the rim and the projection. The lid preferably has a nominal molded thickness of between about 0.25 and 1.25 millimeters (mm). Similarly, the projection is preferably formed of plastic molded to have a generally constant nominal wall thickness of between about 0.25 and 1.25 mm.

In some applications, the projection is integrally molded as an extension of the planar surface and has a side wall that extends, from a fillet at the base to the distal end, at a constant taper rate. The side wall preferably defines an angle of between about 20 and 35 degrees with a primary axis of the projection.

In some embodiments of the invention, the projection is roughly frustro-conical. Preferably the projection includes stiffening ribs extending from back surfaces of the segments, each stiffening rib located between two adjacent break lines. In some embodiments, the projection also has a distal end surface generally perpendicular to a primary axis of the projection. The break lines preferably intersect in a central region of the distal end surface. In these embodiments, insertion of a straw through the projection axially displaces portions of the distal end surface outward from an inserted straw due to the frustro-conical shape of the projection. This preferably enhances engagement of the segment bases with the outer surface of the straw.

There are at least two primary sets of alternate embodiments of the break lines. In the first set, the break lines are slits extending through the projection. In these embodiments, the break lines preferably intersect at an opening through the projection, the opening defining a flow area of less than about 0.5 square millimeters through the lid with the segments unseparated. In the second set, the break lines are molded to be thinner than the nominal wall thickness of the projection. In these embodiments, in the break lines, the projection preferably has a molded wall thickness of less than about 0.125 mm.

In some embodiments, stress relief holes extend through the projection at the break lines ends.

The materials and dimensions of the projection are preferably such that, after separation of the segments by straw insertion, and after subsequent straw removal followed by washing in an automated dishwasher, the separated segments will have returned sufficiently toward their unseparated positions that distal ends of adjacent segments are separated by less than about 1.25 mm.

According to another aspect of the invention, the method of drinking from a cup preferably includes providing a straw and a drinking cup with a lid, inserting a straw into a straw receptacle in the lid and through a projection in the lid thus forcing projection segments apart so that segment bases engage an outer surface of the inserted straw to inhibit leakage; and applying suction to the straw to draw fluid out of the drinking cup through the straw.

The details of exemplary embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
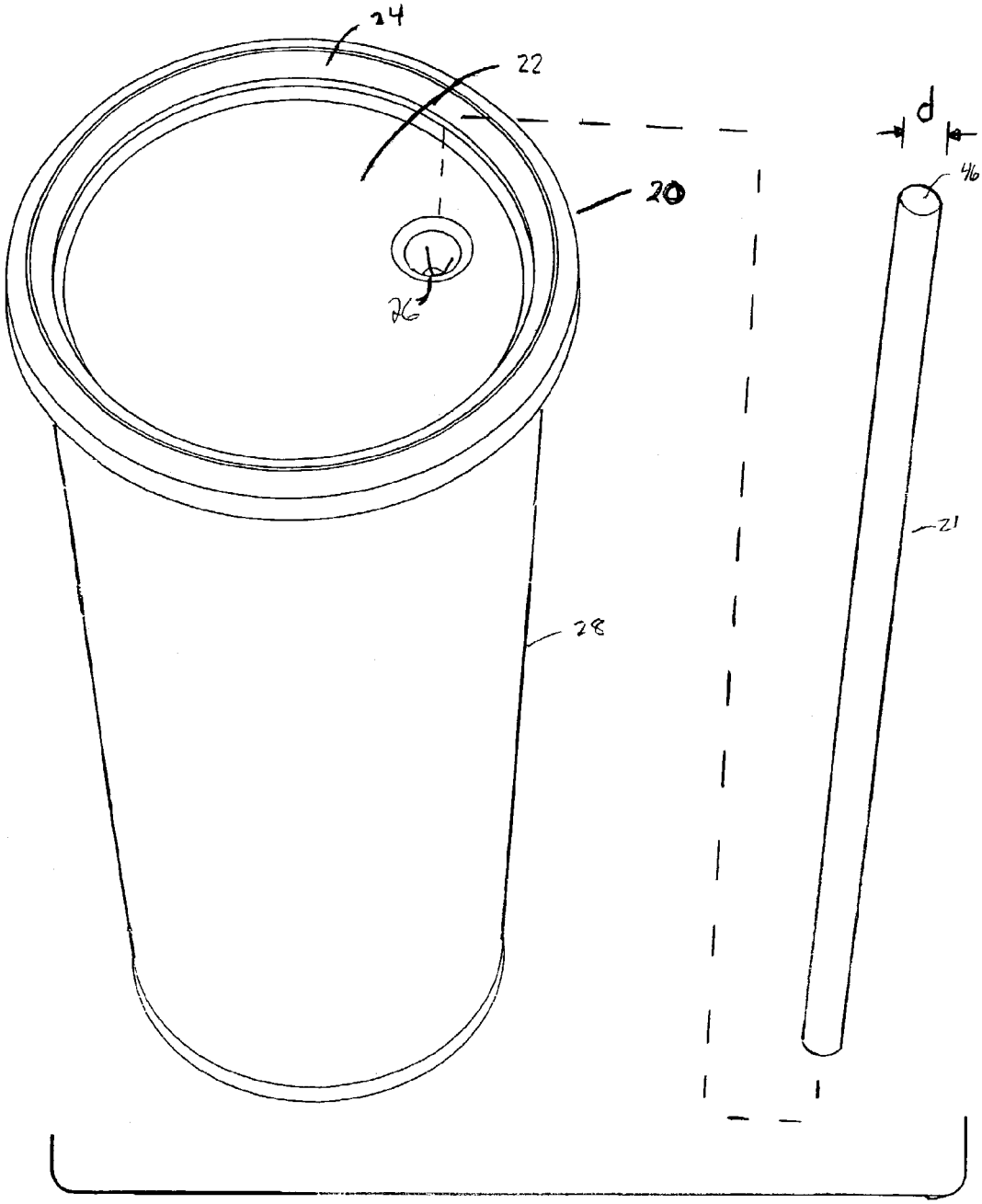
FIG. 1 is a perspective view of the lid on a drinking cup and a straw.

FIG. 1 shows a lid 20, a straw 21, and a drinking cup 28. The lid is a body 22 with a rim 24 and a projection 26 extending integrally from an underside of the body 22. The lid 20 is releasably securable about a lip of a drinking cup 28 to form a seal.

Figure 2:
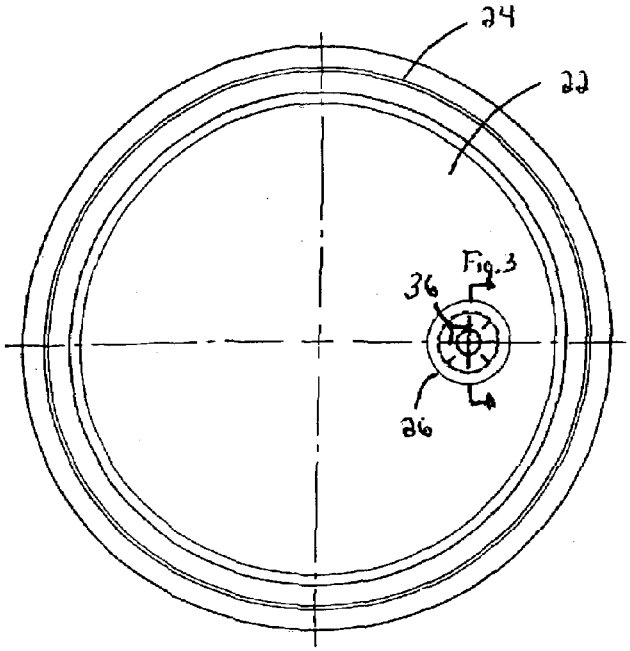
FIG. 2 is a plan view of the lid shown in FIG. 1.
Figure 3:
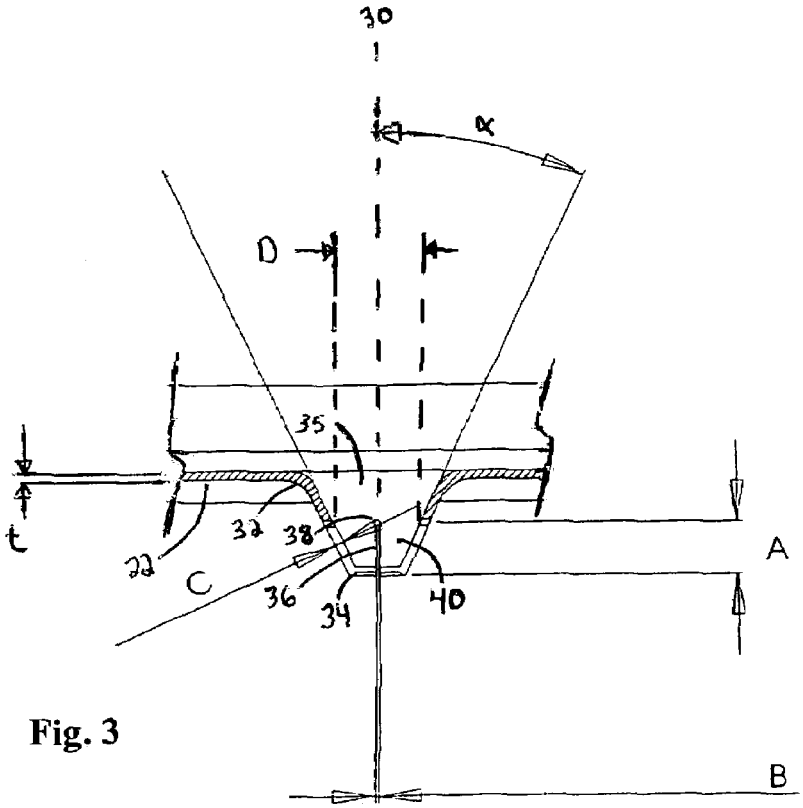
FIG. 3 is a cross-section of the projection shown in FIG. 1 extending integrally from an underside of the lid body.

FIGS. 2 and 3 illustrate further features of the lid 20. FIG. 2 is a plan view of lid 20 and FIG. 3 is a cross-section of the projection 26 extending integrally from an underside of the body 22 along a projection axis 30. The projection 26 comprises a hollow structure defining a tapered side wall extending from a relatively broad base 32 at the underside of the body to a distal end 34 and defines, in an upper surface of the lid body 22, a straw receptacle 35. The projection also defines a plurality of break lines 36 extending from its distal end 34 and terminating at break line ends 38 wherein the plurality of break lines define separable segments 40 of the projection 26. The projection 26 preferably consists of 3–6 segments. This facilitates engagement of the straw 21 and lid 20 when the straw is inserted through the projection. There are four segments 40 in the projections shown in FIGS. 1–9.

Figure 4:
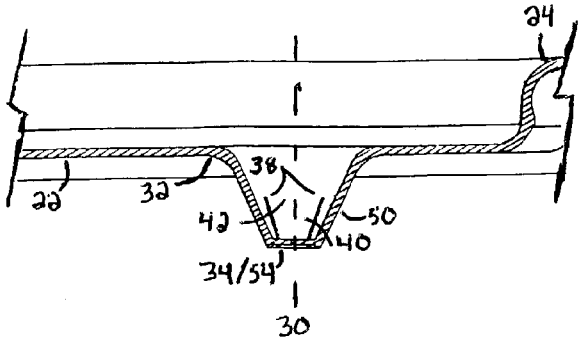
FIGS. 4, 5 and 6 are cross-sectional views of alternate projections.
Figure 5:
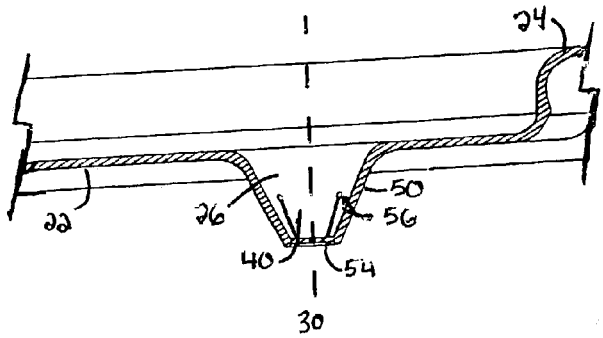
Figure 6:
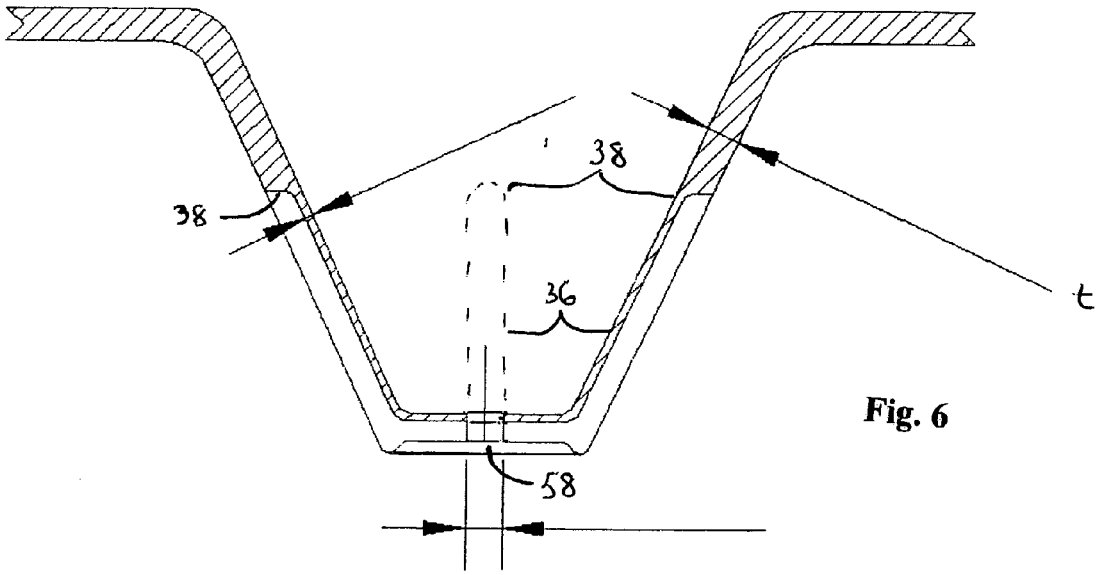
Figure 8:
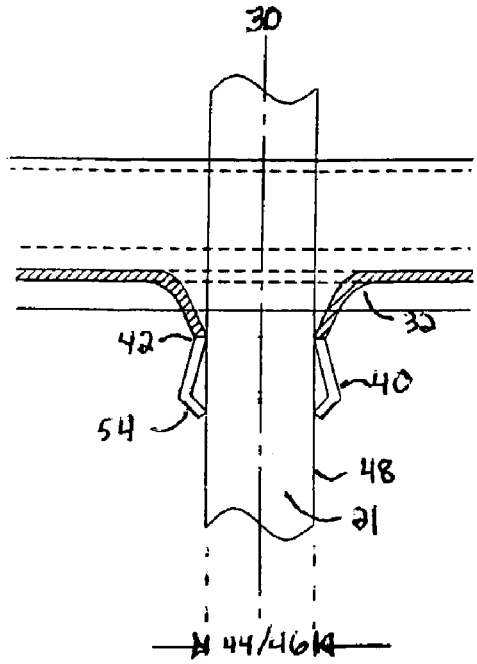
FIG. 8 is a cross-section of the projection with a straw inserted.

The segments 40 are more clearly visible in FIGS. 4, 5, and 6 illustrating alternate embodiments of the projection 26. Now referring to FIG. 4, each segment 40 has a segment base 42 extending between adjacent break line ends 38. The break line ends 38 are spaced from the base 32 of the tapered side wall along the projection axis 30 ("A" in FIG. 3) in a region of the straw receptacle 35 having a cross-section 44 approximately equal in extent to a cross-section 46 (see FIG. 1) of the straw 21 ("D" in FIG. 3). As shown in FIG. 8, inserting the straw 21 into the straw receptacle 35 and through the projection 26 forces the projection segments 40 apart and the segment bases 42 engage an outer surface 48 of the inserted straw 21 to inhibit leakage.

In the lid shown in FIGS. 1 and 2, the lid 20 is a unitary piece of molded plastic. Preferably the body 22 forms a generally planar, rigid surface extending between the rim 24 and the projection 26 and has a nominal molded thickness ("t" in FIG. 3) of between about 0.6 and 0.7 millimeters.

In some lids, the projection 26 is integrally molded as an extension of the planar surface of the body 22, as shown in FIG. 4. The side wall 50 of the projection 26 extends, from a fillet at the base 32 to the distal end 34, at a constant taper rate. Typically, the side wall 50 defines an angle ("$\alpha$" in FIG. 3) of between about 20 and 35 degrees with the primary axis 30 of the projection 26. In these lids, the projection 26 is formed of plastic molded to have a generally constant nominal wall thickness ("C" in FIG. 3) of between about 0.25 and 1.25 mm.

Figure 7:
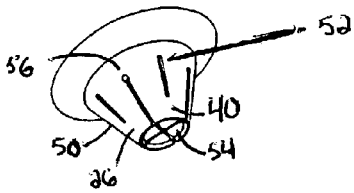
FIG. 7 is an underside perspective view of a projection with stiffening ribs.

In the lids shown in FIGS. 4, 5, 6, and 7 the projection 26 is roughly frustro-conical. Stiffening ribs 52 can be added between adjacent break lines 36 as shown in FIG. 7. A distal end surface 54 is generally perpendicular to a primary axis 30 of the projection 26 and the break lines 36 intersect in a central region (not labeled) of the distal end surface 54. In the lids shown in FIGS. 5 and 7, stress relief holes 56 extend through the projection at the break lines ends 38. The stress relief holes 56 act to inhibit inadvertent extension of the break lines 36 beyond the break line ends 38 when a straw 21 is inserted through the projection 26. As shown in FIG. 8, insertion of a straw 21 through the projection 26 radially displaces portions of the distal end surface 54 outward from the inserted straw to bow the segments 40 away from the straw while maintaining engagement of the segment bases 42 with the outer surface of the straw 21.

FIG. 3 shows a lid in which the break lines 36 are slits extending through the projection 26. FIG. 6 shows an example in which the break lines 36 are regions of the projection 26 molded to be thinner than the nominal wall thickness of the projection 26. In this example, in the break lines, the projection preferably has a molded wall thickness of less than about 0.125 mm.

In some lids, the break lines 36 intersect at an opening 58 through the projection 26, as shown in FIG. 6. Preferably, the opening is less than about 0.5 square millimeters through the lid before a straw is inserted ("B" in FIG. 3).

Figure 9:
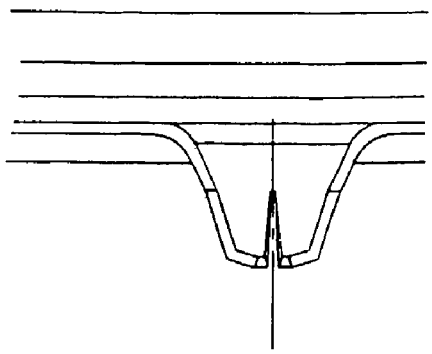
FIG. 9 is a cross-section of the projection after the straw has been removed.

Preferably, the projection is a semi-rigid material. By "semi-rigid", we mean a material that is not rubber-like or elastomeric, that is not elastic or resilient in use, as opposed, for example, to materials typically employed to form baby bottle nipples and the like. Molded polypropylene is a presently preferred semi-rigid material. Preferably, the resin and dimensions of the projection 26 are selected to cause the segments 40 to at least partially return to their original positions after the straw is removed, as shown in FIG. 9. In particular, if the lid is washed in an automated dishwasher, the separated segments tend to return sufficiently toward their unseparated positions that distal ends of adjacent segments are separated by less than about 1.25 mm. Those skilled in the art will recognize that other materials can be used without departing from the spirit of the present invention.

In use, an adult will install the straw simply by pressing it though the projection from the upper surface of the lid, in a manner consistent with intuition and other straw-type lids. Preferably for cups for younger children, an insertion force of between about 18 and 89 Newtons is required for initial penetration. The required penetration force is preferably low enough for easy straw insertion by parents, while the straw removal force is preferably high enough to prevent or inhibit removal of the straw by very young children.

A number of embodiments of the invention have been described. Nevertheless, it will be understood that various modifications may be made without departing from the spirit and scope of the invention. For example, other materials can be used for the projection that result in the separated segments returning towards their unseparated positions after the lid is washed in an automated dishwasher. Accordingly, other embodiments are within the scope of the following claims.

What is claimed is:

1. In combination, a drinking straw and a removable lid for a drinking cup, the lid comprising:

a body with a rim releasably securable about a lip of a drinking cup to form a seal therewith; and a projection extending integrally from an underside of the body along a projection axis, the projection comprising a hollow structure defining a tapered side wall extending from a relatively broad base to a distal end, the projection defining, in an upper surface of the lid body, a straw receptacle;

the projection defining a plurality of break lines extending from its distal end and terminating at break line ends wherein the plurality of break lines define separable segments of the projection therebetween, each segment having a segment base extending between adjacent break line ends, the break line ends disposed on the tapered sidewall of the projection and spaced from the base of the tapered side wall along the projection axis in a region of the straw receptacle having a cross-section approximately equal in extent to a cross-section of the straw such that inserting the straw into the straw receptacle and through the projection forces the projection segments from an unseparated position to a deployed position, the segment bases engaging an outer surface of the inserted straw to inhibit leakage.

2. The straw and lid of claim 1 wherein the lid is a unitary piece of molded plastic.

3. The straw and lid of claim 2 wherein the body forms a generally planar, rigid surface extending between the rim and the projection and has a nominal molded thickness of between about 0.25 and 1.25 millimeters.

4. The straw and lid of claim 3 wherein the projection is integrally molded as an extension of the planar surface.

5. The straw and lid of claim 4 wherein the side wall extends at a constant taper rate.

6. The straw and lid of claim 5 wherein the side wall defines an angle of between about 20 and 30 degrees with a primary axis of the projection.

7. The straw and lid of claim 4 wherein the projection is formed of plastic molded to have a generally constant nominal wall thickness of between about 0.25 and 1.25 millimeters.

8. The straw and lid of claim 1 wherein the projection is roughly frustro-conical.

9. The straw and lid of claim 8 wherein the projection further comprises a plurality of stiffening ribs, each stiffening rib located between two adjacent break lines.

10. The straw and lid of claim 8 wherein the projection further comprises a distal end surface generally perpendicular to a primary axis of the projection.

11. The straw and lid of claim 10 wherein insertion of the straw through the projection radially displaces portions of the distal end surface outward to bow the segments away from the straw while maintaining engagement of the segment bases with the outer surface of the straw.

12. The straw and lid of claim 10 wherein the break lines intersect in a central region of the distal end surface.

13. The straw and lid of claim 12 wherein stress relief holes extend through the projection at the break lines ends.

14. The straw and lid of claim 12 wherein the break lines comprise slits extending through the projection.

15. The straw and lid of claim 14 wherein the break lines intersect at an opening through the projection, the opening defining a flow area of less than about 0.5 square millimeter through the lid with the segments unseparated.

16. The straw and lid of claim 12 wherein the break lines comprise projection regions molded to be thinner than the nominal wall thickness of the projection.

17. The straw and lid of claim 16 wherein, in the break lines, the projection has a molded wall thickness of less than about 0.125 millimeters.

18. The straw and lid of claim 1 wherein materials and dimensions of the projections are such that, after separation of the segments by straw insertion, and after subsequent straw removal followed by washing in an automated dishwasher, the separated segments will have returned sufficiently toward their unseparated positions that distal ends of adjacent segments are separated by less than about 1.25 millimeters.

19. A removable lid for a drinking cup, the lid comprising:

a body with a rim releasably securable about a lip of a drinking cup to form a seal therewith; and a projection extending integrally from an underside of the body along a projection axis, the projection comprising a hollow structure defining a tapered side wall extending from a relatively broad base to a distal end, the projection defining, in an upper surface of the lid body, a straw receptacle;

the projection defining a plurality of break lines extending from its distal end and terminating at break line ends wherein the plurality of break lines define separable segments of the projection therebetween, each segment having a segment base extending between adjacent break line ends, the break line ends disposed on the tapered sidewall of the projection and spaced from the base of the tapered side wall along the projection axis in a region of the straw receptacle having a line end cross-section such that inserting a straw, having a cross-section approximately equal in extent to the line end cross-section of the projection, into the straw receptacle and through the projection forces the projection segments from an unseparated position to a deployed position apart, the segment bases engaging an outer surface of the inserted straw to inhibit leakage.

20. The lid of claim 19 wherein the lid is a unitary piece of molded plastic.

21. The lid of claim 20 wherein the projection is integrally molded as an extension of the planar surface.

22. The lid of claim 21 wherein the side wall extends at a constant taper rate.

23. The lid of claim 19 wherein the projection is roughly frustro-conical.

24. The lid of claim 23 wherein insertion of the straw through the projection radially displaces portions of the distal end surface outward to bow the segments away from the straw while maintaining engagement of the segment bases with the outer surface of the straw.

25. The lid of claim 23 wherein the projection further comprises a plurality of stiffening ribs, each stiffening rib located between two adjacent break lines.

26. The lid of claim 23 wherein the break lines intersect in a central region of the distal end surface.

27. The lid of claim 26 wherein stress relief holes extend through the projection at the break lines ends.

28. The lid of claim 26 wherein the break lines comprise slits extending through the projection.

29. The lid of claim 26 wherein the break lines comprise projection regions molded to be equal to or thinner than the nominal wall thickness of the projection.

30. The lid of claim 19 wherein materials and dimensions of the projection are such that, after separation of the segments by straw insertion, and after subsequent straw removal followed by washing in an automated dishwasher, the separated segments will have returned sufficiently toward their unseparated positions that distal ends of adjacent segments are separated by less than about 1.25 millimeters.

31. A method of drinking from a cup comprising:

providing a straw and a drinking cup with a lid, the lid comprising a body with a rim releasably securable about a lip of the drinking cup to form a seal therewith; and a projection extending integrally from an underside of the body along a projection axis, the projection comprising a hollow structure defining a tapered side wall extending from a relatively broad base to a distal end, the projection defining, in an upper surface of the lid body, a straw receptacle;

the projection defining a plurality of break lines extending from its distal end and terminating at break line ends wherein the plurality of break lines define separable segments of the projection therebetween, each segment having a segment base extending between adjacent break line ends, the break line ends disposed on the tapered side wall of the projection and spaced from the base of the tapered side wall along the projection axis in a region of the straw receptacle having a cross-section approximately equal in extent to a cross-section of the straw;

inserting a straw into the straw receptacle and through the projection thus forcing the projection segments apart, the segment bases engaging an outer surface of the inserted straw to inhibit leakage; and applying suction to the straw to draw fluid out of the drinking cup through the straw.

32. The method of claim 31 wherein the lid is a unitary piece of molded plastic.

33. The method of claim 32 wherein the projection is integrally molded as an extension of the planar surface.

34. The method of claim 33 wherein the side wall extends at a constant taper rate.

35. The method of claim 31 wherein the projection is roughly frustro-conical.

36. The method of claim 35 wherein the projection further comprises a plurality of stiffening ribs, each stiffening rib located between two adjacent break lines.

37. The method of claim 35 wherein the break lines intersect in a central region of the distal end surface.

38. The method of claim 37 wherein stress relief holes extend through the projection at the break lines ends.

39. The method of claim 37 wherein the break lines comprise slits extending through the projection.

40. The method of claim 37 wherein the break lines comprise projection regions molded to be equal to or thinner than the nominal wall thickness of the projection.

41. The method of claim 31 wherein the materials and dimensions of the projection are such that, after separation of the segments by straw insertion, and after subsequent straw removal followed by washing in an automated dishwasher, the separated segments will have returned sufficiently toward their unseparated positions that distal ends of adjacent segments are separated by less than about 1.25 millimeters.

42. The straw and lid of claim 1 wherein the break lines comprise projection regions molded to be thinner than the nominal wall thickness of the projection, and wherein the protrusion has a smooth continuous inner surface extending across the segment bases.

43. The lid of claim 19 wherein the break lines comprise projection regions molded to be thinner than the nominal wall thickness of the projection, and wherein the protrusion has a smooth continuous inner surface extending across the segment bases.

* * * * *